US012428182B1

(12) United States Patent
Hord et al.

(10) Patent No.: US 12,428,182 B1
(45) Date of Patent: Sep. 30, 2025

(54) PACKAGING SKATE SYSTEM AND METHOD

(71) Applicant: Encore Wire Corporation, McKinney, TX (US)

(72) Inventors: Harrison J. Hord, The Colony, TX (US); Joshua Cody Collinsworth, Whitewright, TX (US)

(73) Assignee: Encore Wire Corporation, McKinney, TX (US)

( * ) Notice: Subject to any disclaimer, the term of this patent is extended or adjusted under 35 U.S.C. 154(b) by 156 days.

(21) Appl. No.: 18/084,769

(22) Filed: Dec. 20, 2022

Related U.S. Application Data

(60) Provisional application No. 63/291,800, filed on Dec. 20, 2021.

(51) Int. Cl.
*B65B 11/04* (2006.01)
*B65H 65/00* (2006.01)

(52) U.S. Cl.
CPC ..... *B65B 11/04* (2013.01); *B65H 65/00* (2013.01); *B65H 2701/34* (2013.01)

(58) Field of Classification Search
CPC ..... B65B 11/02; B65B 11/04; B65H 65/00; B65H 2701/34; B65H 75/44
See application file for complete search history.

(56) References Cited

U.S. PATENT DOCUMENTS 1,612,262 A * 12/1926 Coggins ..... B65B 25/148 53/136.2
2,716,315 A * 8/1955 Jacoby ..... B65B 11/04 493/299
3,863,425 A * 2/1975 Edwards ..... B65B 11/04 493/269
3,928,939 A * 12/1975 Edwards ..... B65B 11/04 53/442
4,144,696 A * 3/1979 Gustavsson ..... B65B 11/04 53/442
4,173,108 A * 11/1979 Eglinton ..... B65B 11/04 53/587
4,565,051 A * 1/1986 Back ..... B65B 11/04 53/449
5,203,139 A * 4/1993 Salsburg ..... B65B 11/04 53/118
5,265,399 A * 11/1993 Niskanen ..... B65B 25/148 53/136.2
5,715,655 A * 2/1998 Soderberg ..... A01F 15/071 53/556

(Continued)

*Primary Examiner* — Andrew M Tecco
(74) *Attorney, Agent, or Firm* — Warren Rhoades LLP

(57) ABSTRACT

An apparatus, system, and method for wrapping a plastic film over a wire or cable wound on a spool or reel. The system comprising a packaging assembly, the packaging assembly further comprising a plastic film, a plastic film payoff shaft connected to the plastic film, a vertical support connected to the plastic film payoff shaft, a first conveyor roller coupled to the vertical support, a rotational drive system mechanically coupled to the first conveyor roller, a spool or reel, the spool or reel comprising wound wire or cable, wherein the rotational drive system rotates the first conveyor roller which rotates the spool or reel, pulling the plastic film to partially surround the wire or cable on the spool or reel as the spool or reel is rotated.

18 Claims, 6 Drawing Sheets

(56) References Cited

U.S. PATENT DOCUMENTS

| | | | | |
|---|---|---|---|---|
| 5,966,904 | A * | 10/1999 | Peters | B65B 11/04 53/64 |
| 7,883,046 | B2 * | 2/2011 | Inman | B65H 75/4486 242/390.8 |
| 8,191,337 | B2 * | 6/2012 | Moore | B65H 55/046 53/409 |
| 8,302,895 | B2 * | 11/2012 | Inman | B65H 75/38 242/390.8 |
| 2010/0084500 | A1 * | 4/2010 | Inman | H02G 11/02 242/390.8 |
| 2010/0139211 | A1 * | 6/2010 | Moore | B65H 54/62 53/204 |
| 2015/0245563 | A1 * | 9/2015 | Heaney | B65B 35/30 53/113 |
| 2015/0360800 | A1 * | 12/2015 | Shelander | B65B 61/06 53/399 |

* cited by examiner

PACKAGING SKATE SYSTEM AND METHOD

CROSS-REFERENCE TO RELATED APPLICATIONS

The subject application claims priority to and benefit of U.S. Provisional Application Ser. No. 63/291,800, filed on Dec. 20, 2021, which is fully incorporated by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention relates in general to packaging solutions for manufactured reels of cables. More specifically, it relates to a system and method for the automated application of plastic film, wrap, or the like, to manufactured reels of cables.

2. Description of Related Art

After the manufacturing process of cables, each cable is wound onto a separate spool or reel by a spooling machine for subsequent shipment, storage, and use. Such spools and reels are well known in the art and are generally comprised of wood, plastic, or steel, depending on the type of electrical wire or cable, designated application, or customer preference. This process is commonly referred to as the spooling process. Once the spooling process is complete, adhesive-backed labels are then manually applied to the wound cables to identify and describe the cable contained on the spool or reel. However, adhesive-backed labels applied directly to wound cables may easily be removed, lost, or damaged, and become illegible. This is a greater problem for armored cable or metal-clad cable, due to the lack of a uniform surface for adhesion, namely the alternating peaks and valleys of the armored cable or metal-clad cable.

The traditional solution to this problem is the manual application of a transparent polymer plastic film, wrap, or the like, transversely around a spool or reel to at least partially surround the circumference of the cable, by at least one operator, after the spooling process is complete. Such plastic stretch films and shrink wraps are well known in the art. This application of the polymer plastic film, wrap, or the like, allows the operators to securely apply adhesive-backed labels onto said polymer plastic shrink film, or the like, to identify and describe the armored cable or metal-clad cable contained on the spool or reel.

This manual application of a transparent polymer plastic film, wrap, or the like, however, has several drawbacks. One such drawback is the lack of efficiency: this manual application process is burdensome, tedious, and time-consuming because operators are required to manually rotate heavy and cumbersome spools or reels of cable during the application process. This results in a slow and inefficient packaging process as well as an inconsistent wrap quality from reel to reel. Additional drawbacks include the significant costs for additional operators; excess waste of stretch films or shrink wraps; and the significant floor space required for this manual application process. Additionally, this prior art system has resulted in additional safety concerns for its operators since the wound spool and reels are often heavy and cumbersome.

Semi-automatic stretch film wrapping machines and horizontal stretch wrapping machines are also known. These semi-automatic stretch film wrapping machines, however, are limited in nature because they are typically suited to a particular application. One such example known as the G Series Semi-Automatic Stretch Wrapper has been commercialized by Lantech. This system, however, does not provide a solution for an industrial application, namely the application of stretch films or shrink wraps to spools or reels of wound cable. Instead, this system is limited wholly and exclusively to pallet applications, namely using stretchable plastic films to secure products firmly in place on pallets for shipping and distribution.

Therefore, a need exists for a packaging skate system and method that automatically, reliably, and efficiently applies a transparent polymer plastic film, wrap, or the like, transversely around a spool or reel to at least partially surround the circumference of the wound cable in an industrial environment, without the disadvantages of the existing systems and methods.

BRIEF SUMMARY OF THE INVENTION

The present disclosure is directed at system and method for an improved packaging solution for manufactured spools or reels of cables, including armored cables and metal-clad cables. An improved system and method for the application of a transparent polymer plastic film, wrap, or the like, transversely around a spool or reel, to at least partially surround the circumference of the wound cable, in an industrial environment is disclosed.

The disclosed system and method eliminates the manual application of a transparent polymer plastic film, wrap, or the like, around a wound spool or reel of cable. More specifically, this system and method is wholly independent of an operator's ability to manually rotate a heavy and cumbersome wound spools or reels, as well as an operator's ability to manually apply a plastic film, wrap, or like, during the application process. Instead, this system and method automatically applies a plastic film, wrap, or like, to at least partially surround the circumference of the wound cable by rotating the wound spool or reel relative to the packaging system. In this system and method, according to one embodiment, a rotational drive system provides the relative rotation of the wound spool or reel for the application of the polymer plastic film, wrap, or the like to the wound cable. The rotational drive system is controlled by a microprocessor, which is programmed to drive the wound spool or reel at a predetermined speed for a predetermined number of revolutions to ensure that that a substantially constant length of the polymer plastic film, wrap, or the like is dispensed and applied to the cable of the wound spool or reel during each revolution. As a result, this system and method eliminates the slow and inefficient manual packaging process as well as an inconsistent wrap quality from reel to reel, as well as the greater expenses and losses associated therewith.

In addition, this system and method eliminates the need for and expenses of additional operators, the significant floor space to accommodate one or more operators per wound spool or reel, and the additional safety concerns for the operators during the manual application process. According to one embodiment, this improved system and method utilizes a programable digital control system to accommodate wound spools or reels of varying sizes to automatically, consistently, and efficiently apply a plastic film, wrap, or like, to wound spools or reels of cable.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
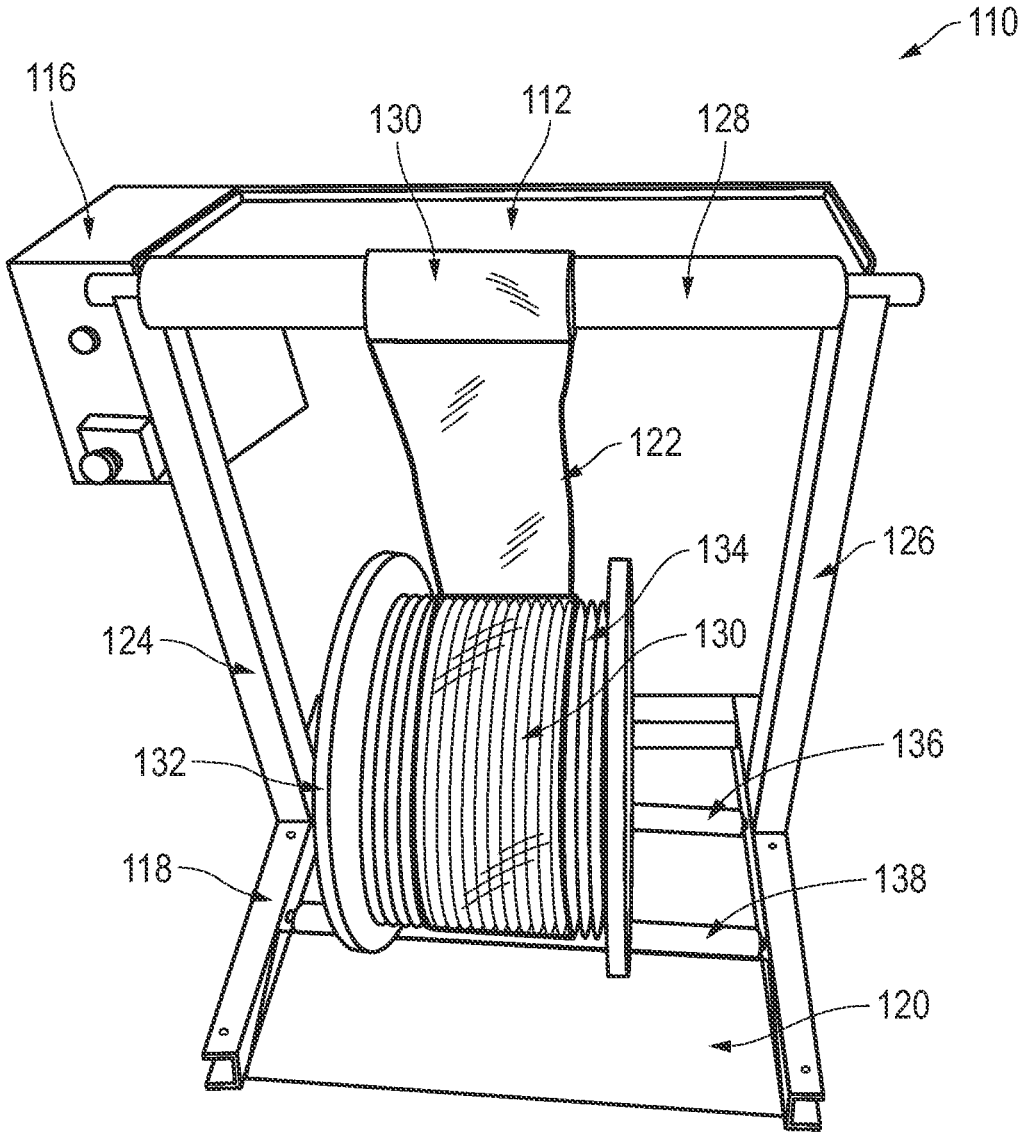
FIG. 1 illustrates a perspective view of the packaging skate system and a spool or reel in accordance of an embodiment of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by accompanying claims.

The present disclosure is described below with reference to the Figures in which various embodiments of the present invention are shown. The subject matter of the disclosure may, however, be embodied in many different forms and should not be construed as limited to the exemplary embodiments set forth herein. It is also understood that the term "cable" is not limiting, and refers to wires, cables, electrical lines, or any other conductive materials.

The present disclosure provides for a system and method for the improved application of a transparent polymer plastic film, wrap, or the like, to spools or reels of armored cables and metal-clad cables Referring now to FIGS. 1-5, by way of non-limiting example, and consistent with embodiments of the invention, a packaging skate system 110 is shown. The packaging skate system 110 may be constructed from any number of materials that are able to withstand the pressures and demands placed upon it, including, but not limited to, metal or wood.

Figure 2:
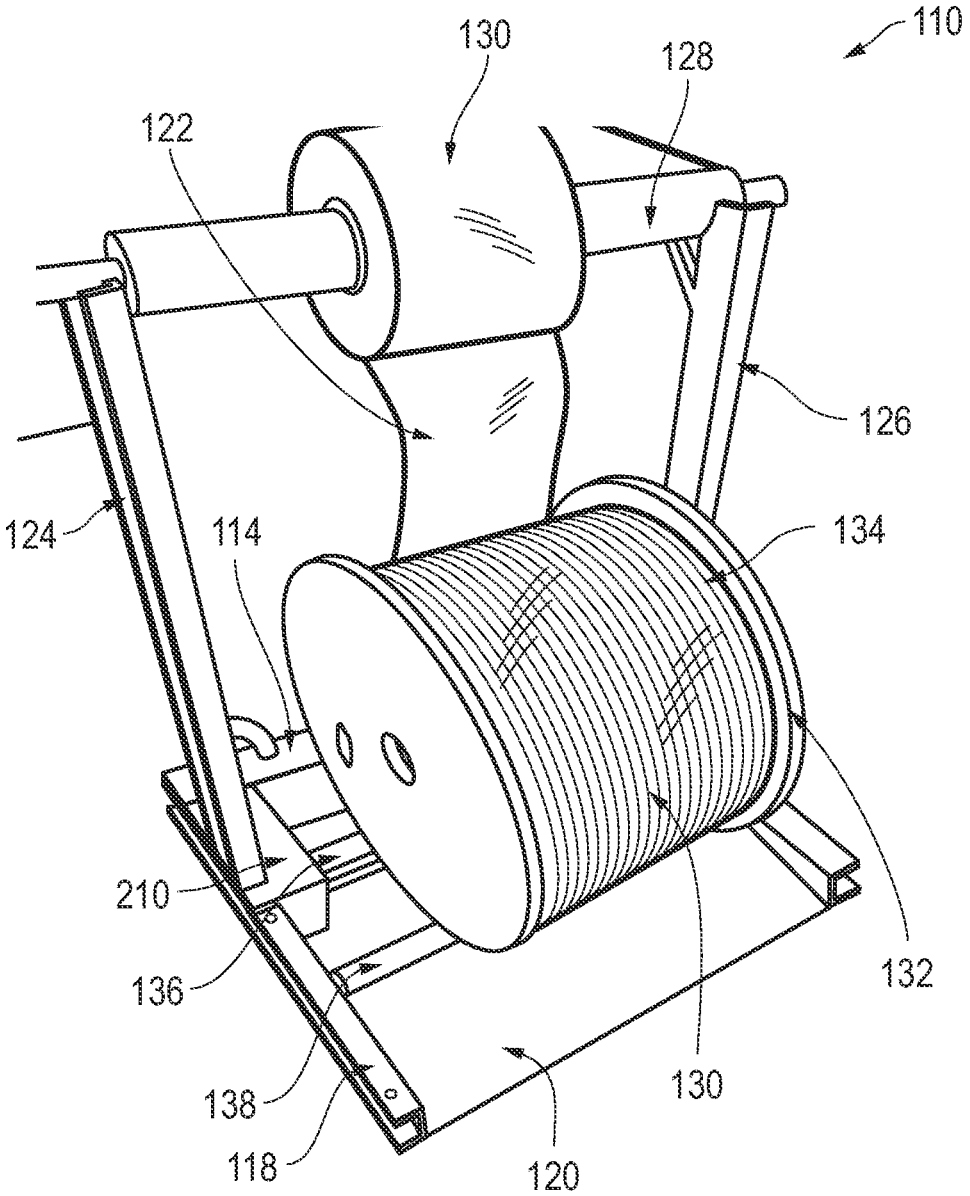
FIG. 2 is a detailed view of an embodiment of a packaging skate assembly and a spool or reel in accordance of an embodiment of the invention.
Figure 3:
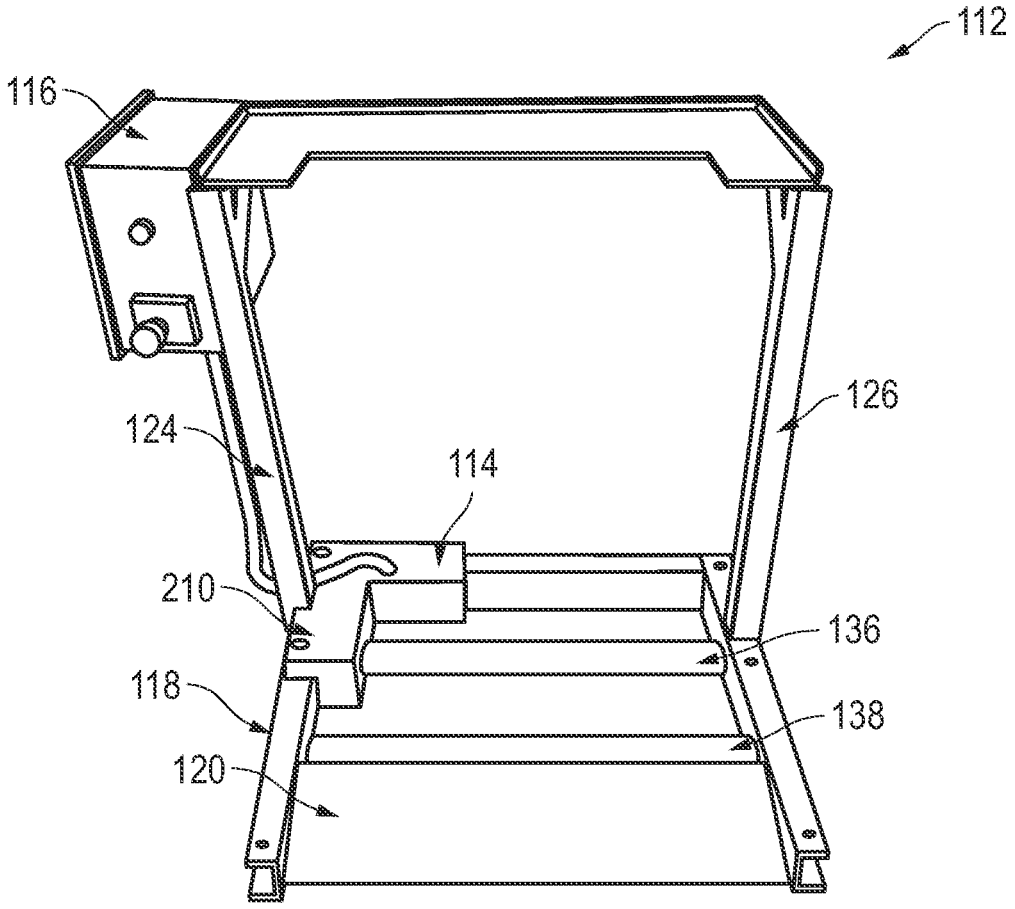
FIG. 3 is a detailed view of an embodiment of a packaging skate assembly in accordance of an embodiment of the invention.
Figure 5:
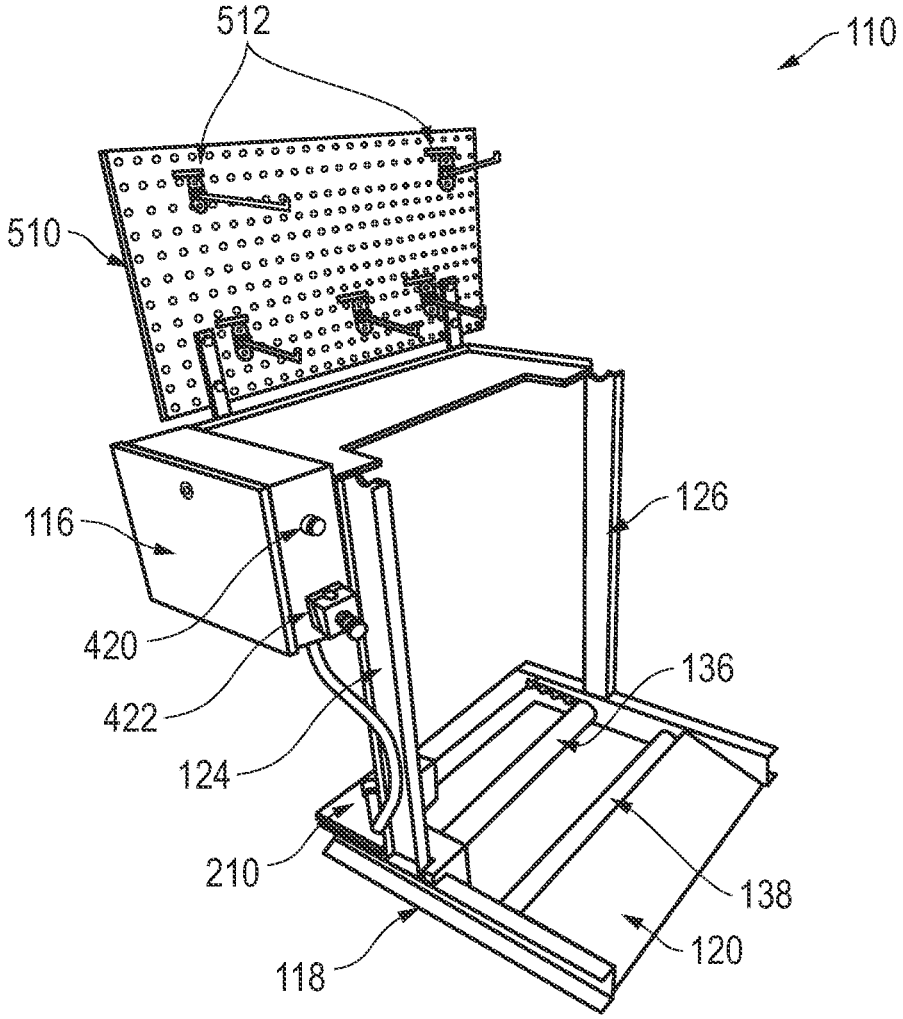
FIG. 5 is a perspective view of an embodiment of a packaging skate assembly including a storage and dispensing device in accordance of an embodiment of the invention.

According to one embodiment, the packaging skate system 110 includes a packaging skate assembly 112, a motor assembly 114, a controller 116 and a power supply (not shown). The packaging skate assembly 112 includes a base roller assembly 118, a ramp 120, a payoff path 122, a first and second vertical support 124, 126, and a payoff shaft 128. In this embodiment, the payoff shaft 128 is coupled to the first and second vertical supports 124, 126 of the packaging skate assembly 112. The payoff shaft 128 may be located at a wide variety of location around the packaging skate assembly 112 including, but not limited to, the top or back of the packaging skate assembly 112. The coupling of the payoff shaft 128 to the first and second vertical supports 124, 126 provides the payoff shaft 128 with the ability to freely rotate along its horizontal axis. In another embodiment, the payoff shaft 128 is coupled to the first and second vertical supports 124, 126 of the packaging skate assembly 112 by a shaft collar, or the like, providing the payoff shaft 128 with the ability to freely rotate along its horizontal axis. In another embodiment, the payoff shaft 128 is fixedly attached to the first and second vertical supports 124, 126. As shown in FIGS. 2-3 and 5, the packaging skate system 110 may also include a safety guard 210 to enclose the motor assembly 114. The safety guard 210, keeps both the operator's hands and tooling away from pinch points of the motor assembly 114 and provides a safe environment for the operator during operation of the packaging skate system 110.

In one embodiment, the packaging skate system 110 is designed to pay off a plastic film 130 from the payoff shaft 128 along the payoff path 122 to transversely apply a plastic film 130 around a spool or reel 132 to at least partially surround the circumference of a wound cable 134, including, but not limited to, armored cable or metal-clad cable. The plastic film 130 may be provided in the form of a roll and may be applied across the entire inner span of the spool or reel 132 covering the entire top layer of cable 134 or the plastic film 130 may be applied across a portion of the span covering less than the entire top layer of the cable 134. In this embodiment, the plastic film 130 is a transparent polymer plastic stretch film. It should be understood that the packaging skate system 110 may utilize a variety of different types of plastic films or wraps, including plastic shrink wrap, without detracting from the spirit of the invention. As shown in FIGS. 1-2, the payoff shaft 128 of the packaging skate system 110 is capable of utilizing plastic films 130 of varying sizes. The plastic film roll 130 may be rotationally connected to the payoff shaft 128 or the plastic film roll 130 may be fixedly attached to the payoff shaft 128 when the payoff shaft 128 is rotationally connected to the first and second vertical supports 124, 126. In either embodiment, the plastic film roll 130 is able to rotate allowing the plastic film 130 to be dispersed on to the wire or cable reel or spool 132.

In one embodiment, the base roller assembly 118 contains a first and second conveyor roller 136, 138. In an embodiment, the first conveyor roller 136 is a chain-driven roller containing a roller chain sprocket on one end, while the second conveyor roller 138 is a free-spinning roller. It should be understood that the packaging skate system 110 may utilize one or more conveyor rollers 136, 138 in various locations of the base roller assembly 118 to accommodate varying reel or spool sizes. The distance between the conveyor rollers 136, 138 is adjustable by movement of one or both of the conveyor rollers 136, 138. The conveyor rollers 136, 138 are replaceable and rebuildable. The conveyor rollers 136, 138 may be constructed from a variety of materials including, but not limited to, aluminum, steel, stainless-steel, and plastic; and may also contain a rubber-coating, or plastic-coating on the surface of the conveyor rollers 136, 138. It should be understood that the packaging skate system 110 may utilize a variety of different types of power conveyor rollers 136 including, but not limited to, belt-driven conveyor rollers, internally powered conveyor rollers, electromagnetic conveyor rollers or any other means of operating a power conveyor roller, without detracting from the spirit of the invention.

Figure 4:
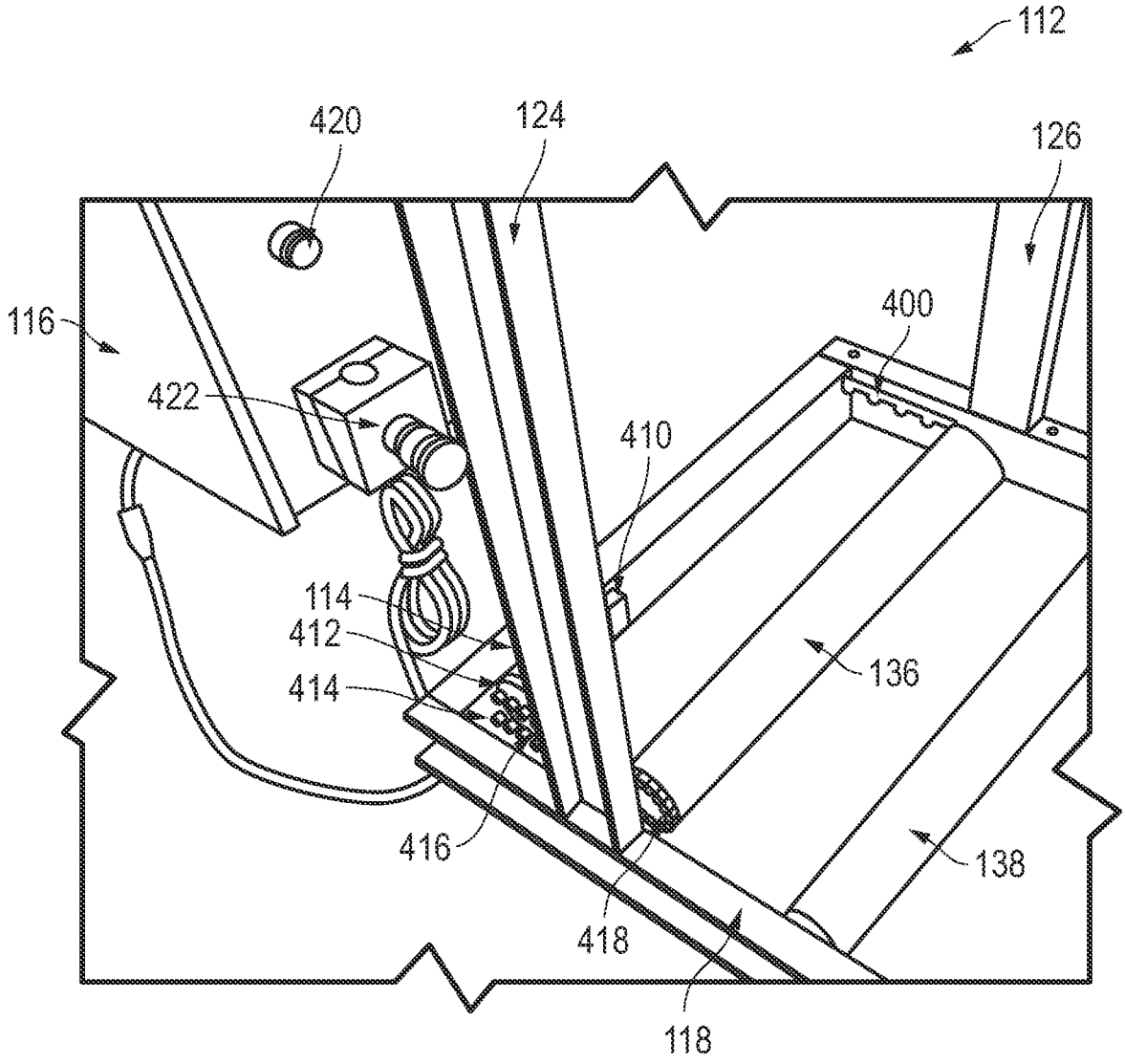
FIG. 4 is a detailed view of an embodiment of a motor assembly of the packaging skate system in accordance of an embodiment of the invention.

The design of the base roller assembly 118 is advantageous over the prior art because the packaging skate system 110 improves the packaging solution of wound spools or reels 132 of cable 134 by eliminating the need of additional operators and additional floor space to apply a plastic film 130 transversely around varying sizes of heavy and cumbersome wound spools or reels 132, as well as the greater expenses and losses associated therewith. In an embodiment, the first conveyor roller 132 is adjustable along the base roller assembly 118 and may be installed at different locations 400 along the base roller assembly 118, as shown in FIG. 4, to accommodate varying sizes of wound spools or reels 132 of cable 134.

In one embodiment, the motor assembly 114 is coupled to the packaging skate assembly 112 of the packaging skate system 110. In this embodiment, the motor assembly 114 is a rotational drive system that provides the relative rotation of the wound spools or reels 132 of cable 134 as described herein. As shown in FIG. 4, the motor assembly 114 includes a motor 410, a gearbox 412 containing a roller chain sprocket 414 coupled to the output shaft of the gearbox 412, and a multiple link chain 416. The motor 410 of the packaging skate system 110 is mechanically linked to the gearbox 412 through the shaft of the motor 410. The multiple link chain 416 mechanically links the roller chain sprocket 414 of the gearbox 412 to the roller chain sprocket of first conveyor roller 136 of the base roller assembly 118 to provide the relative rotation of the wound spools or reels 132 of cable 134. In one embodiment, the motor 410 converts electrical energy from the power source into mechanical energy, which is translated to the gearbox 412 through the motor shaft. In this embodiment, the gearbox 412 increases the torque from the motor 410 and transmits that increased torque to its roller chain sprocket 414. The multiple link chain 416 transfers the torque from the roller chain sprocket 414 of the gearbox 412 to the roller chain sprocket 418 of the first conveyor roller 136 of the base roller assembly 118, resulting in the horizontal rotation of the first conveyor roller 136. In another embodiment, the motor assembly 114 is capable of directly powering the roller chain sprocket of first conveyor roller 136 of the base roller assembly 118 without a gearbox 412. It should be understood that the packaging skate system 110 may utilize a variety of different types of motors 410 including, but not limited to, AC motors, DC motors, servo motors, stepper motors, linear motors, or any other means of driving a conveyor roller, without detracting from the spirit of the invention.

In one embodiment, controller 116 is coupled to the packaging skate assembly 112 of the packaging skate system 110. The controller 116 includes a microprocessor (not shown). As shown in FIGS. 4-5, the controller 116 is operated by a start button 420 and an emergency stop button 422. In operation, the microprocessor of the controller 116 is programmed so that the motor assembly 114 will rotate the first conveyor roller 136 of the base roller assembly 118 for a predetermined number of revolutions, at a predetermined speed, once the start button is pressed by an operator. Rotating the first conveyor roller 136 at a predetermined speed for a predetermined number of revolutions ensures that that a substantially constant length of plastic film 130 is pulled and dispensed from the payoff shaft 128 during each revolution. In one embodiment, the controller 116 includes a conventional microprocessor and a user interface, such as a control screen or the like, to operate the packaging skate system 110. In an embodiment, the user interface includes a programmable logic controller (PLC). In this embodiment, the user interface allows the operator to change certain parameters including, but not limited to, the reel size, the reel diameter, motor speed, acceleration, offsets, the number of revolutions, and the total duration. Alternative control schemes can be utilized by the packaging skate system 110 and include different communication links between the microprocessor and the motor assembly 114. A wide variety of controller functionality is known to those skilled in the art including, but not limited to, preset data such as speed and revolutions as well as adjustable data by the user such as speed and revolutions.

In operation, according to one embodiment, a wound spool or reel 132 of cable 134 is manually positioned onto the base roller assembly 118 of the packaging skate assembly 112, via the ramp 120, by an operator. Once the wound spool or reel 132 of cable 134 is loaded onto the first and second conveyor rollers 136, 138, the operator manually attaches the end of the plastic film 130 to the wound cable 134. The packaging skate system 110 is activated by the controller 116 when the operator presses the start button 420. Once activated by a signal from the controller 116, the motor assembly 114 rotates the first conveyor roller 136 of the base roller assembly 118 at a predetermined speed for a predetermined number of revolutions. In this embodiment, the powered rotation of the first conveyor roller 136 causes the wound spool or reel 132 to rotate horizontally on both the first and second conveyor rollers 136, 138 of the base roller assembly 118. In turn, this rotation of the wound spool or reel 132 pulls the plastic film 130 by and from the rotation of the payoff shaft 128 along the payoff path 122 to be transversely applied around the spool or reel 132 to at least partially surround the circumference of the wound cable 134. When the first conveyor roller 136 has completed the predetermined number of revolutions, as determined by the microprocessor, the controller 116 automatically ends the rotation of the first conveyor roller 136 to stop the wound spool or reel 132 at its current position. Once the wound spool or reel 132 comes to a complete stop, the excess plastic film 130 between the payoff shaft 128 and the wrapped wound spool or reel 132 is cut and the excess plastic film 130 is secured to the armored cable or metal-clad cable 134. The cutting and securing of the excess plastic film 130 may be completed by an operator, in one embodiment, or automatically with a cutting device (not shown) by the packaging skate system 110 in another embodiment. In one embodiment, the spool or reel 132 is rotated so that the operator attaches the end of the plastic film 130 to the end of the cable 134.

As shown in FIG. 5, according to one embodiment, the packaging skate system 110 includes a labeling material storage and dispenser 510 coupled to the packaging skate assembly 112 of the packaging skate system 110. In this embodiment, the labeling material storage and dispenser 510 is comprised of several hooks 512 to store and easily dispense rolls of adhesive-backed labels that identify or describe the armored cable or metal-clad cable contained on the spool or reel 132. A wide variety of labeling material storage and dispenser systems may be implemented without detracting from the spirit of the invention.

The disclosed system and method is independent of the operator's ability to manually rotate and wrap heavy and cumbersome wound spool or reels 132 during the application process of applying plastic films 130. As a result, this system and method eliminates the slow and inefficient manual packaging process as well as an inconsistent wrap quality from reel to reel, as well as the greater expenses and losses associated therewith. Additionally, this system and method eliminates the need for and expenses of additional operators, the significant floor space to accommodate one or more operators per wound spool or reel, as well as the additional safety concerns for the operators during the manual application process.

Figure 6:
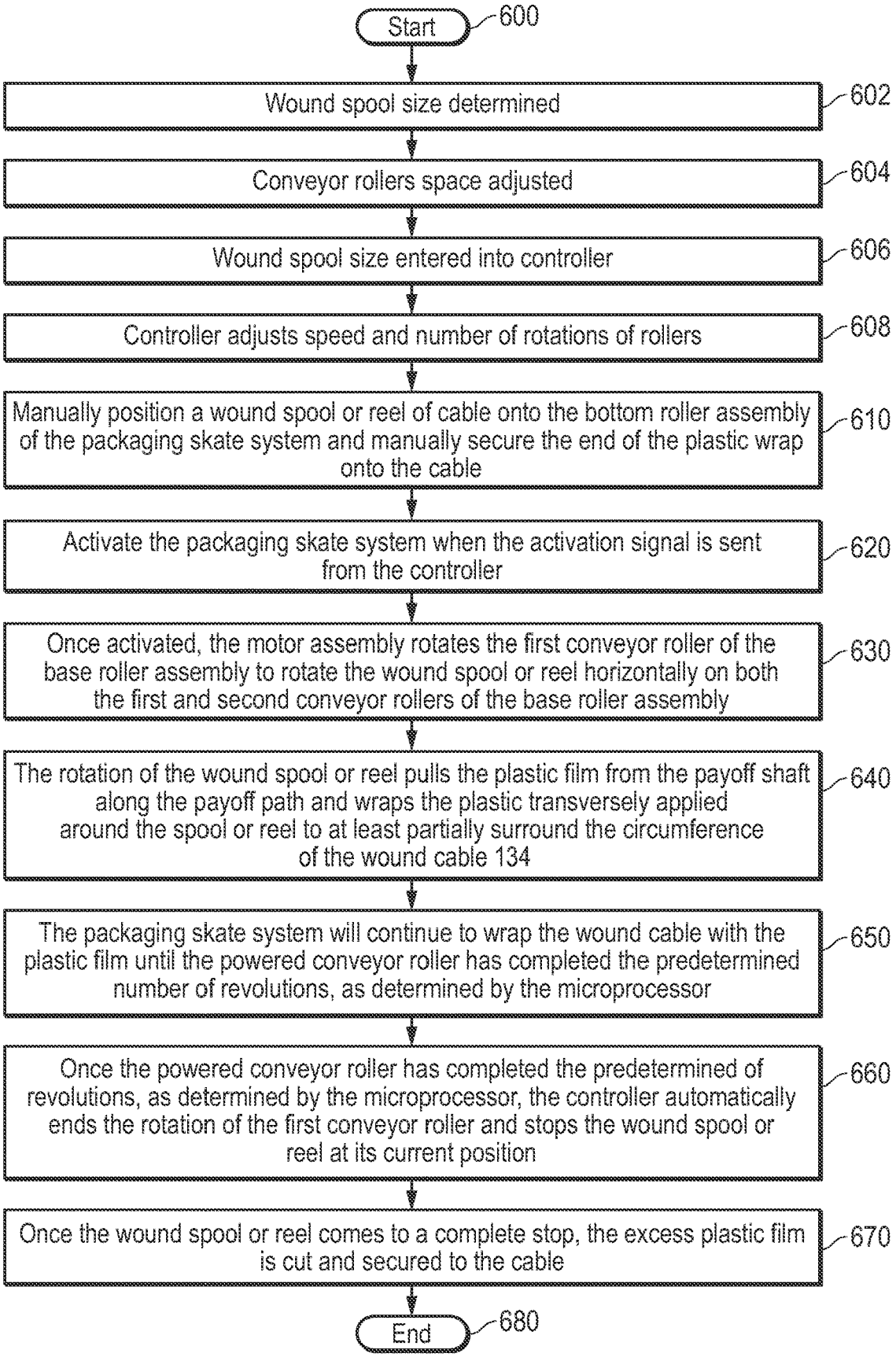
FIG. 6 is a flow chart of the packaging skate method in accordance with an embodiment of the invention.

Referring now to FIG. 6, a flow chart of the packaging skate method is shown. The method begins with Start 600. Next, in step 602, the size of the wound spool or reel 132 is determined. Based upon the size of the wound spool or reel 132, the space between the conveyor rollers 136, 138 is adjusted to accommodate the specific size of the wound spool or reel 132 in step 604. The size of the wound spool or reel 132 is then entered into the controller in step 606. The controller controls the speed and number of rotations of the conveyor rollers 136, 138 which controls the wound spool or reel 132 based upon predetermined data associated with the specific wound spool or reel 132 size in step 608. Through the use of specific rotational speed and numbers of rotations, the amount of plastic film 130 used is optimized. Next, in step 610, a wound spool or reel 132 of cable 134 is manually positioned onto the base roller assembly 118 of the packaging skate assembly 112, via the ramp 120, by an operator. Once the wound spool or reel 132 of armored cables or metal-clad cable 134 is loaded onto the first and second conveyor rollers 136, 138, the operator manually attaches the end of the plastic film 130 to the wound cable 134. Next, in step 620, the packaging skate system 110 is activated by a signal from the controller 116 when the operator presses the start button 420. Next, in step 630, once activated by a signal from the controller 116, the motor assembly 114 rotates the first conveyor roller 136 of the base roller assembly 118 to rotate the wound spool or reel 132 horizontally on both the first and second conveyor rollers 136, 138 of the base roller assembly 118. Next, in step 640, the rotation of the wound spool or reel 132 pulls the plastic film 130 from the payoff shaft 128 along the payoff path 122 and causes the plastic film 130 to wrap around the circumference of the wound cable 134 of the spool or reel 132. Next, in step 650, the plastic film 130 continues to wrap around the circumference of the wound cable 134 until the first conveyor roller 136 has completed the predetermined number of revolutions, as determined by the microprocessor. Next, in step 660, once the first conveyor roller 136 has completed the predetermined number of revolutions, as determined by the microprocessor, the controller 116 automatically ends the rotation of the first conveyor roller 136 to stop the wound spool or reel 132 at its current position. Next, in step 670, once the wound spool or reel 132 comes to a complete stop, the excess plastic film 130 between the payoff shaft 128 and the wrapped wound spool or reel 132 is cut and the excess plastic film 130 is secured to the armored cable or metal-clad cable 134. The method ends 680.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical, or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof;

the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. A packaging skate apparatus for wrapping a plastic film over a wire or cable on a spool or reel, the apparatus comprising:

a plastic film;

a plastic film payoff shaft connected to the plastic film;

a vertical support connected to the plastic film payoff shaft;

a base assembly connected to the vertical support;

a first conveyor roller adjustably coupled to the base assembly;

a second conveyor roller fixedly coupled to the base assembly; and a rotational drive system mechanically coupled to the first conveyor roller, wherein the rotational drive system rotates the first conveyor roller which rotates the spool or reel, pulling the plastic film to partially surround the wire or cable on the spool or reel and wherein a location of the first conveyor roller is adjustable along a horizontal path defined by the base assembly and along predetermined locations of the base assembly.

2. The apparatus of claim 1 further comprising a controller connected to rotational drive.

3. The apparatus of claim 1, wherein the first and second conveyor rollers are spaced apart to accept the spool or reel.

4. The apparatus of claim 3 further comprising a ramp coupled to the base assembly.

5. The apparatus of claim 1, wherein the plastic film is rotationally connected to the plastic film payoff shaft.

6. The apparatus of claim 1, wherein the plastic film payoff shaft is rotationally connected to the vertical support.

7. A packaging system for wrapping a plastic film over a wire or cable on a spool or reel, the system comprising:

a packaging assembly, the packaging assembly further comprising:

a plastic film;

a plastic film payoff shaft connected to the plastic film;

a vertical support connected to the plastic film payoff shaft;

a base assembly connected to the vertical support;

a first conveyor roller adjustably coupled to the base assembly;

a second conveyor roller fixedly coupled to the base assembly;

a rotational drive system mechanically coupled to the first conveyor roller;

a spool or reel, the spool or reel comprising wound wire or cable; and wherein the rotational drive system rotates the first conveyor roller which rotates the spool or reel, pulling the plastic film to partially surround the wire or cable on the spool or reel as the spool or reel is rotated and wherein a location of the first conveyor roller is adjustable along a horizontal path defined by the base assembly and along predetermined locations of the base assembly.

8. The system of claim 7 further comprising a controller connected to rotational drive.

9. The system of claim 8, wherein the controller adjusts the speed and duration of rotation of the first conveyor roller in accordance with the wound spool or reel size.

10. The system of claim 8, wherein the controller comprises an emergency stop button.

11. The system of claim 7, wherein the first and second conveyor rollers are spaced apart to accept the spool or reel.

12. The system of claim 11 further comprising a ramp coupled to the base assembly, wherein the spool or reel is rolled up the ramp to be placed between the first and second conveyor rollers.

13. The system of claim 7, wherein the plastic film is rotationally connected to the plastic film payoff shaft.

14. The system of claim 7, wherein the plastic film payoff shaft is rotationally connected to the vertical support.

15. The system of claim 7, wherein the wound wire or cable comprises a wound armored cable.

16. The system of claim 7, wherein the wound wire or cable comprises a metal-clad cable.

17. The system of claim 7, wherein the rotational drive comprises a chain drive.

18. The system of claim 7, wherein the vertical support comprises at least two vertical supports.

* * * * *